US009287031B2

(12) United States Patent
Lee

(10) Patent No.: US 9,287,031 B2
(45) Date of Patent: Mar. 15, 2016

(54) MULTILAYER INDUCTOR AND METHOD OF MANUFACTURING THE SAME

(71) Applicant: SAMSUNG ELECTRO-MECHANICS CO., LTD., Suwon-Si, Gyeonggi-Do (KR)

(72) Inventor: Jung Chul Lee, Suwon-Si (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 12 days.

(21) Appl. No.: 14/214,293

(22) Filed: Mar. 14, 2014

(65) Prior Publication Data

US 2015/0084730 A1 Mar. 26, 2015

(30) Foreign Application Priority Data

Sep. 24, 2013 (KR) ..... 10-2013-0113227

(51) Int. Cl.
*H01F 5/00* (2006.01)
*H01F 17/00* (2006.01)

(52) U.S. Cl.
CPC ..... *H01F 17/0013* (2013.01); *H01F 5/00* (2013.01); *H01F 2017/002* (2013.01); *Y10T 29/4902* (2015.01)

(58) Field of Classification Search
CPC ..... H01F 5/00; H01F 27/00–27/36
USPC ..... 336/65, 83, 200, 232
See application file for complete search history.

(56) References Cited

U.S. PATENT DOCUMENTS 6,304,164 B1 * 10/2001 Ohno et al. ..... 336/200
2011/0050191 A1 3/2011 Tsuji et al.
2013/0319736 A1 * 12/2013 Hurwitz ..... 174/257

FOREIGN PATENT DOCUMENTS

JP 2011-054585 A 3/2011

* cited by examiner

*Primary Examiner* — Tuyen Nguyen
(74) *Attorney, Agent, or Firm* — McDermott Will & Emery LLP

(57) ABSTRACT

A multilayer inductor may include: a body having a plurality of dielectric layers stacked therein; a plurality of conductor patterns formed on the plurality of dielectric layers; via electrodes formed in the dielectric layers and connecting the conductor patterns disposed adjacent to each other in a vertical direction to form a coil; and pad patterns formed between the conductor patterns and the dielectric layers at positions of the via electrodes.

9 Claims, 5 Drawing Sheets

MULTILAYER INDUCTOR AND METHOD OF MANUFACTURING THE SAME

CROSS-REFERENCE TO RELATED APPLICATION

This application claims the benefit of Korean Patent Application No. 10-2013-0113227 filed on Sep. 24, 2013, with the Korean Intellectual Property Office, the disclosure of which is incorporated herein by reference.

BACKGROUND

The present disclosure relates to a multilayer inductor and a method of manufacturing the same.

An inductor, one of important passive elements configuring an electrical circuit together with a resistor and a capacitor, may be used to remove noise or may be used as a component, or the like, configuring an LC resonant circuit.

Particularly, in accordance with improvement in performance of a product such as a smart phone, a Q factor of the inductor at high frequency is important.

Types of inductors may be divided into a winding type inductor, a thin film type inductor, a multilayer type inductor, and the like, depending on a structure thereof.

The winding type inductor or the thin film type inductor may be manufactured by winding or printing a coil around or on a ferrite core and forming electrodes at both ends thereof.

The multilayer inductor may be manufactured by printing conductor patterns on a plurality of sheets formed of a magnetic material, a dielectric material, or the like, and then stacking the plurality of sheets in a thickness direction.

Particularly, the multilayer inductor may be smaller and thinner than the winding type inductor and may also be advantageous for direct current (DC) resistance. Therefore, the multilayer inductor has been mainly used in a power supply circuit or the like that needs to be miniaturized and requires high current.

The multilayer inductor may be formed by printing conductor patterns on sheets formed of a magnetic material and then vertically stacking the sheets. In this case, parasitic capacitance and resistance as well as inductance are provided.

The parasitic capacitance or the resistance causes deterioration in inductance characteristics of the multilayer inductor. In order to improve quality of a product, it is necessary to minimize the parasitic capacitance and the resistance.

Meanwhile, a quality factor related to a relationship between inductance, parasitic capacitance and resistance of the multilayer inductor is called a Q factor.

Generally, when a Q factor of an inductor is improved, the number of layers of the multilayer inductor may be decreased or a degree of freedom of a design depending on space arrangement may be increased.

Therefore, in accordance with the recent trend toward an increase of an available frequency of an electronic product to a high frequency band and an increase in power consumption of the electronic product, research into a multilayer inductor having excellent Q factor has been actively conducted.

SUMMARY

An exemplary embodiment of the present disclosure may provide a multilayer inductor having an improved Q factor, optimizing a vertical distance between conductor patterns while maintaining connectivity of via electrodes, and decreasing an open defect, and a method of manufacturing the same.

According to an exemplary embodiment of the present disclosure, a multilayer inductor may include: a main body having a plurality of dielectric layers stacked therein; a plurality of conductor patterns formed on the plurality of dielectric layers; via electrodes formed in the dielectric layers and connecting the conductor patterns disposed adjacent to each other in a vertical direction to form a coil; and pad patterns formed between the conductor patterns and the dielectric layers at positions of the via electrodes.

An edge of the pad pattern may coincide with an edge of the conductor pattern adjacent to a corresponding side surface of the main body.

The conductor pattern may be formed in a shape corresponding to ½ of a loop, a shape corresponding to ¾ of the loop, a shape corresponding to ⅚ of the loop, and/or a shape nearing the whole loop.

The plurality of conductor patterns may include first and second connection patterns exposed to both end surfaces of the main body.

The multilayer inductor may further include first and second external electrodes formed on the end surfaces of the main body and connected to the first and second connection patterns, respectively.

The multilayer inductor may further include upper and lower cover layers disposed in upper and lower portions of the main body.

According to another exemplary embodiment of the present disclosure, a method of manufacturing a multilayer inductor may include: preparing a plurality of dielectric sheets; forming conductor patterns on the dielectric sheets; forming via electrodes in the dielectric sheets; forming a multilayer body by stacking the dielectric sheets in a state in which pad patterns are disposed between the conductor patterns and the dielectric sheets at positions of the via electrodes, while allowing the conductor patterns disposed adjacent to each other in a vertical direction, the pad patterns and the via electrodes to contact each other to entirely form a single coil, and pressing the stacked dielectric sheets; forming a main body by sintering the multilayer body; and forming first and second external electrodes on both end surfaces of the main body, wherein the plurality of conductor patterns may include first and second connection patterns exposed to the end surfaces of the main body and connected to the first and second external electrodes, respectively.

In the forming of the multilayer body, an edge of the pad pattern may coincide with an edge of the conductor pattern adjacent to a corresponding side surface of the main body.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
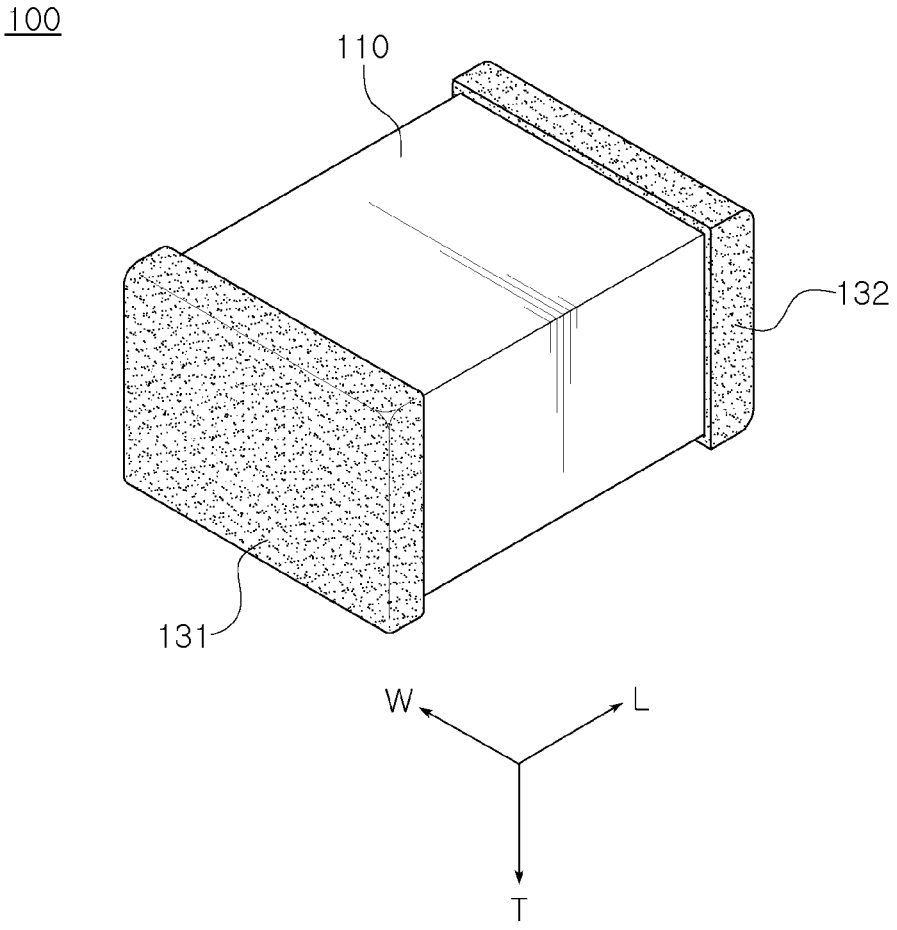
FIG. 1 is a perspective view of a multilayer inductor according to an exemplary embodiment of the present disclosure.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Directions will be defined in order to clearly describe exemplary embodiments of the present disclosure. L, W and T in the accompanying drawings refer to a length direction, a width direction, and a thickness direction, respectively. Here, the width direction may be the same as a stacked direction in which dielectric layers are stacked.

Further, in an exemplary embodiment of the present disclosure, for convenience of explanation, surfaces of a body in a length direction thereof having first and second external electrodes formed thereon refer to end surfaces, surfaces of the body vertically intersecting with the end surfaces refer to side surfaces, and surfaces of the body in a thickness direction thereof refer to upper and lower surfaces.

Figure 2:
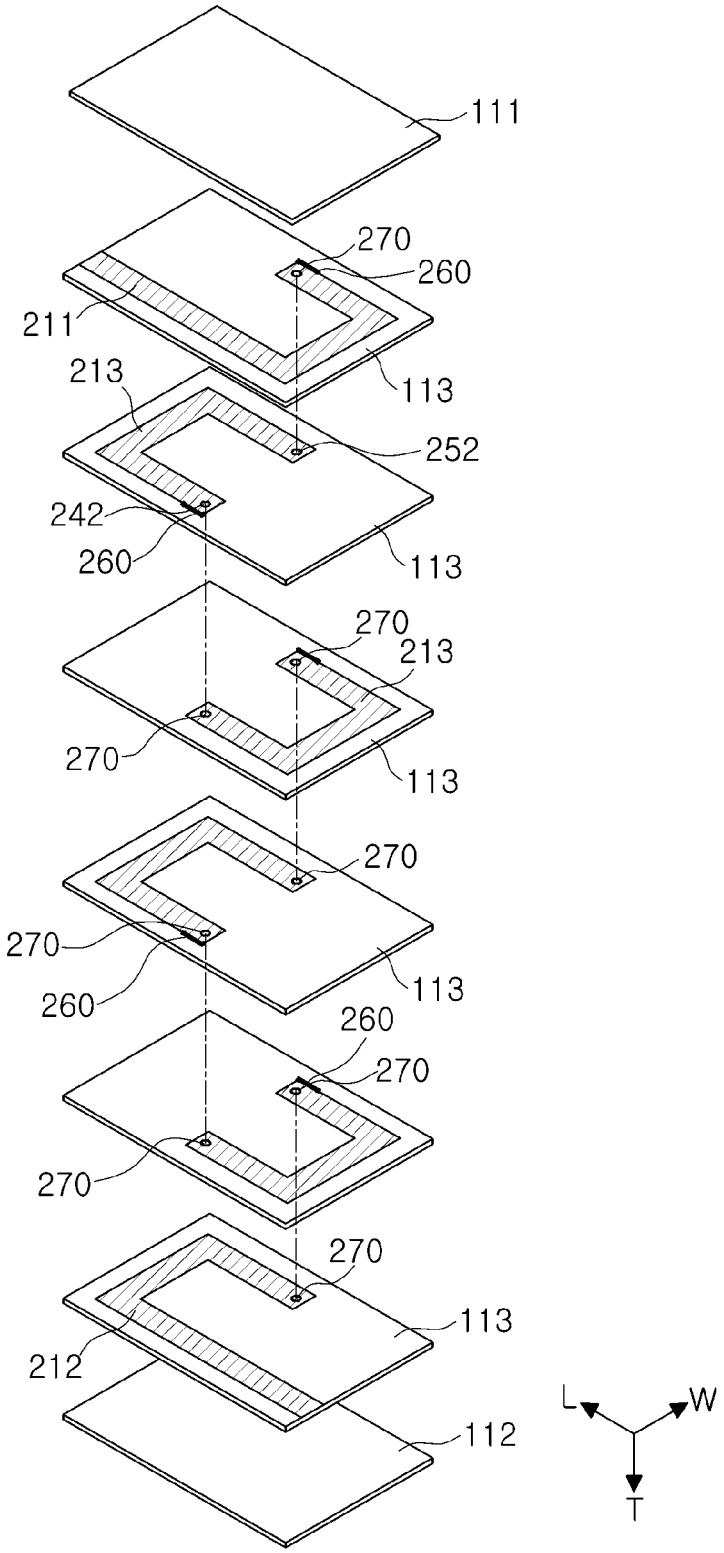
FIG. 2 is an exploded perspective view of the multilayer inductor according to an exemplary embodiment of the present disclosure.

FIG. 1 is a perspective view of a multilayer inductor according to an exemplary embodiment of the present disclosure; and FIG. 2 is an exploded perspective view of the multilayer inductor according to the exemplary embodiment of the present disclosure.

Referring to FIGS. 1 and 2, a multilayer inductor 100 according to an exemplary embodiment of the present disclosure may include a dielectric main body 110, a plurality of conductor patterns 211, 212, and 213, and a plurality of via electrodes 270 connecting the conductor patterns 211, 212, and 213 disposed adjacent to each other in a vertical direction to form a coil, and pad patterns 260 formed between the conductor patterns 211, 212, and 213 and dielectric layers 113.

In addition, the dielectric main body 110 may have first and second external electrodes 131 and 132 formed on both end surfaces thereof.

Here, the dielectric main body 110 may further have upper and lower cover layers 111 and 112 formed in upper and lower portions thereof, respectively, in order to protect the plurality of printed conductor patterns 211, 212, and 213 inside the dielectric main body 110.

Each of the upper and lower cover layers 111 and 112 may be formed of a single dielectric sheet or by stacking a plurality of dielectric sheets in the thickness direction of the main body.

The dielectric main body 110 may be formed by stacking the plurality of dielectric layers 113 formed of the dielectric sheets in the thickness direction thereof and then sintering the stacked dielectric layers 113. A shape and a dimension of the dielectric main body 110 and the number of stacked dielectric layers 113 are not limited to examples shown in FIGS. 1 and 2.

The conductor patterns 211, 212, and 213 may be formed by printing a conductive paste containing a conductive metal on the dielectric layers 113 at a predetermined thickness.

For example, the conductor patterns 211, 212, and 213 may be formed of a material containing silver (Ag) or copper (Cu), or an alloy thereof, but are not limited thereto.

In addition, a total number of stacked dielectric layers 113 having the conductor patterns 211, 212, and 213 formed thereon may be determined in consideration of electrical characteristics such as an inductance value, and the like, according to design requirements of a multilayer inductor.

In addition, in an exemplary embodiment of the present disclosure, the conductor patterns 211, 212, and 213 may have a shape corresponding to ¾ of a loop. However, the shape of the conductor pattern is not limited thereto. That is, shapes of the conductor patterns 211, 212, and 213 may be changed into a shape corresponding to ½ of the loop, a shape corresponding to ⅚ of the loop, a shape nearing the whole loop, or the like, if necessary.

At least two of the conductor patterns may be first and second connection patterns 211 and 212 having lead parts exposed to both end surfaces of the main body 110, respectively.

The lead parts may contact and be electrically connected to the first and second external electrodes 131 and 132 formed on both end surfaces of the main body 110, respectively.

In addition, the first and second connection patterns 211 and 212 are illustrated as being disposed at upper and lower portions of the main body 110 in this exemplary embodiment of the present disclosure; however, the present disclosure is not limited thereto.

Figure 3:
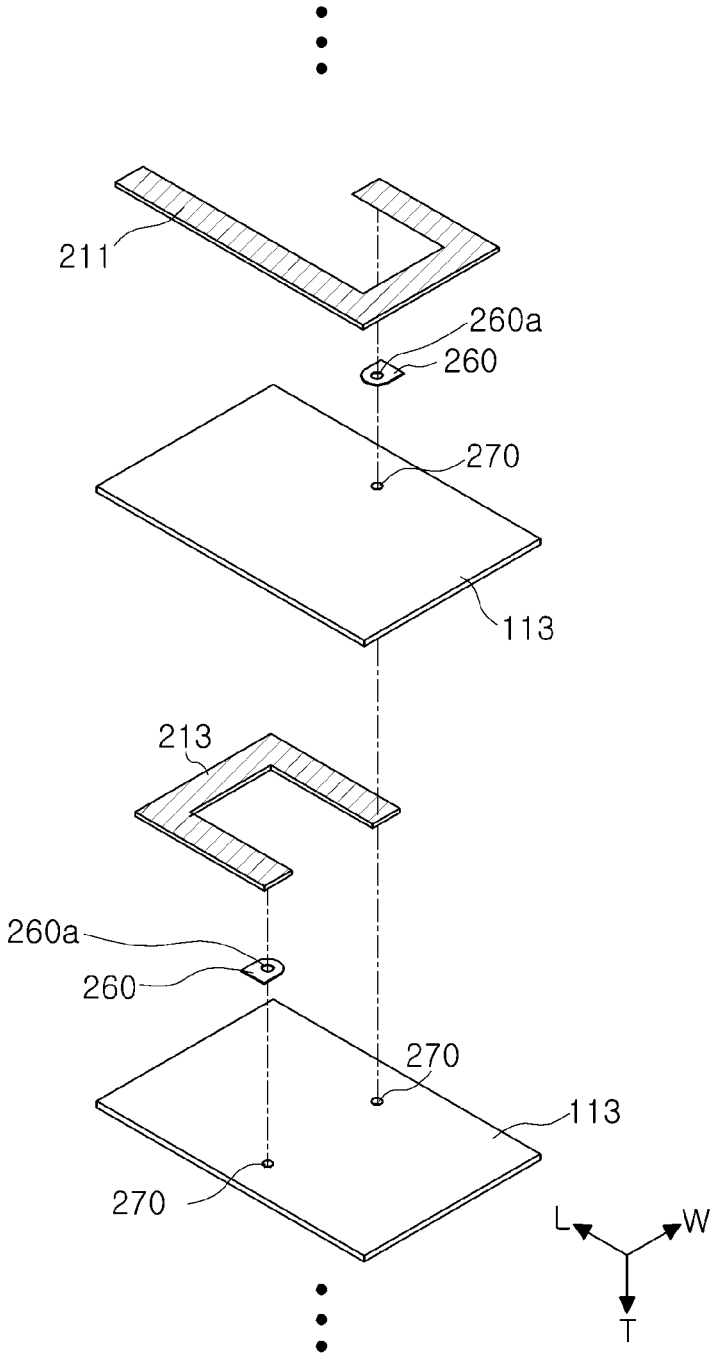
FIG. 3 is an exploded perspective view showing some of dielectric layers, conductor patterns, via electrodes, and pad patterns of the multilayer inductor according to an exemplary embodiment of the present disclosure.
Figure 4:
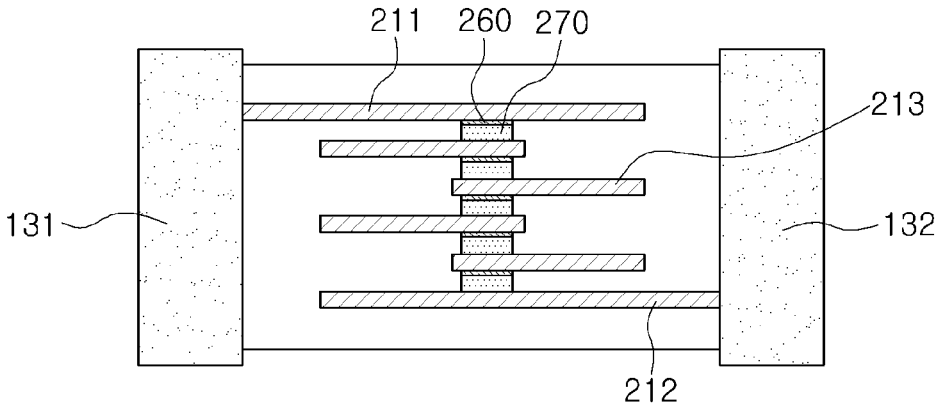
FIG. 4 is a cross-sectional view of the multilayer inductor according to an exemplary embodiment of the present disclosure.

FIG. 3 is an exploded perspective view showing some of dielectric layers, conductor patterns, via electrodes, and pad patterns of the multilayer inductor according to an exemplary embodiment of the present disclosure; and FIG. 4 is a cross-sectional view of the multilayer inductor according to the exemplary embodiment of the present disclosure.

Referring to FIGS. 3 and 4, in the present exemplary embodiment, the pad pattern 260 may be formed at a position of the via electrode 270 between the conductor patterns 211 and 213 and the dielectric layers 113. The dielectric layers 113 may have via holes (not shown) formed therein so that the via electrodes 270 penetrating therethrough are formed therein.

The via electrode 270 may be formed by filling the via hole formed in the dielectric layer 113 with a conductive paste having excellent electrical conductivity.

The conductive paste may be formed of at least one of silver (Ag), silver-palladium (Ag—Pd), nickel (Ni), copper (Cu) and alloys thereof, but is not limited thereto.

The first and second external electrodes 131 and 132 may be formed on both end surfaces of the main body 110, respectively, and may contact and be electrically connected to both ends of the coil, that is, the lead parts of the first and second connection patterns 211 and 212 exposed outwardly, respectively.

The first and second external electrodes 131 and 132 may be formed of a conductive metal having excellent electrical conductivity.

For example, the first and second external electrodes 131 and 132 may be formed of a material containing at least one of silver (Ag) and copper (Cu) or an alloy thereof, but are not limited thereto.

In addition, a nickel (Ni) plated layer (not shown) and a tin (Sn) plated layer (not shown) may be sequentially formed on outer surfaces of the first and second external electrodes 131 and 132, if necessary.

In a multilayer inductor according to the related art, as a dielectric layer becomes thick, a rate of filling a conductive paste within a via hole is decreased, such that a Q factor may be deteriorated and an open defect may occur.

On the other hand, in the multilayer inductor 100 according to an exemplary embodiment of the present disclosure, the pad patterns 260 may be disposed between the conductive patterns 211, 212, and 213 and the dielectric layers 113, thereby optimally controlling a vertical distance between the conductive patterns while maintaining connectivity of the via electrodes 270.

Therefore, the deterioration of the Q factor and the occurrence of the open defect may be prevented.

Here, an edge of the pad pattern 260 may coincide with an edge of the conductor pattern adjacent to a corresponding side surface of the main body 110 in order to secure a margin between the side surface of the main body and the edge of the conductor pattern.

In addition, the pad pattern 260 may be formed of a conductive paste containing a conductive metal. For example, the pad pattern 260 may be formed of a material containing silver (Ag) or copper (Cu), or an alloy thereof, but is not limited thereto.

Figure 5:
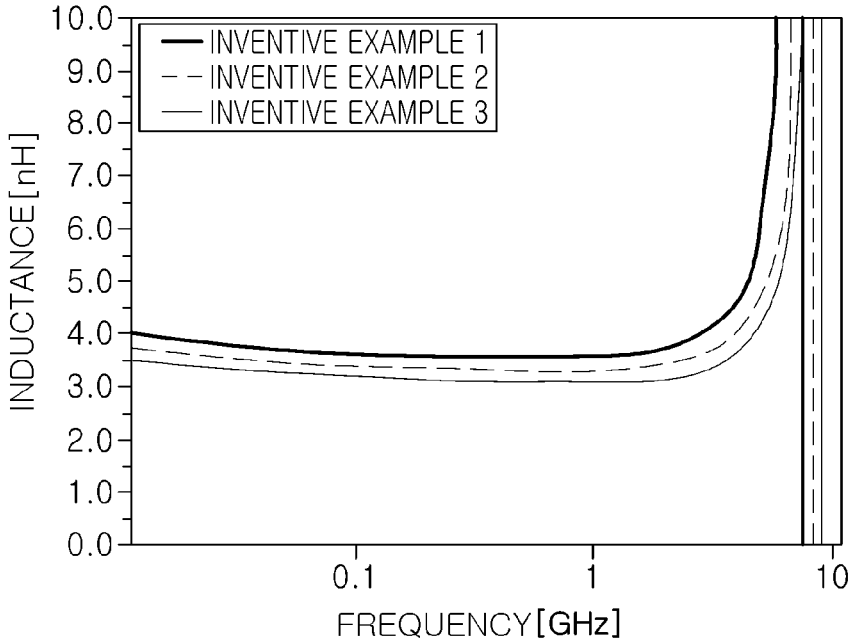
FIG. 5 is a graph showing inductance of the multilayer inductor according to an exemplary embodiment of the present disclosure.
Figure 6:
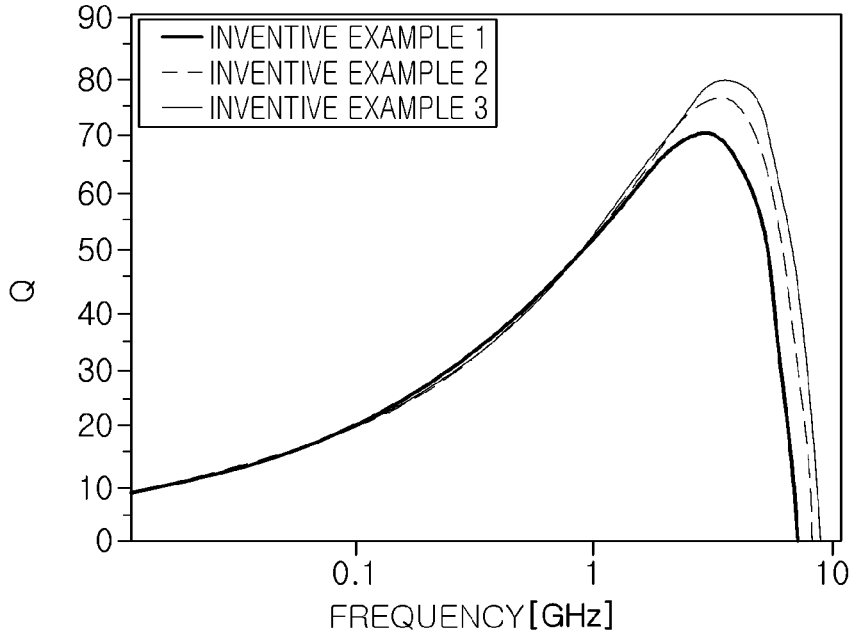
FIG. 6 is a graph showing a Q factor of the multilayer inductor according to an exemplary embodiment of the present disclosure.

FIG. 5 is a graph showing inductance of the multilayer inductor according to an exemplary embodiment of the present disclosure; FIG. 6 is a graph showing a Q factor of the multilayer inductor according to the exemplary embodiment of the present disclosure; and FIG. 7 is a graph showing resistance of the multilayer inductor according to the exemplary embodiment of the present disclosure.

Figure 7:
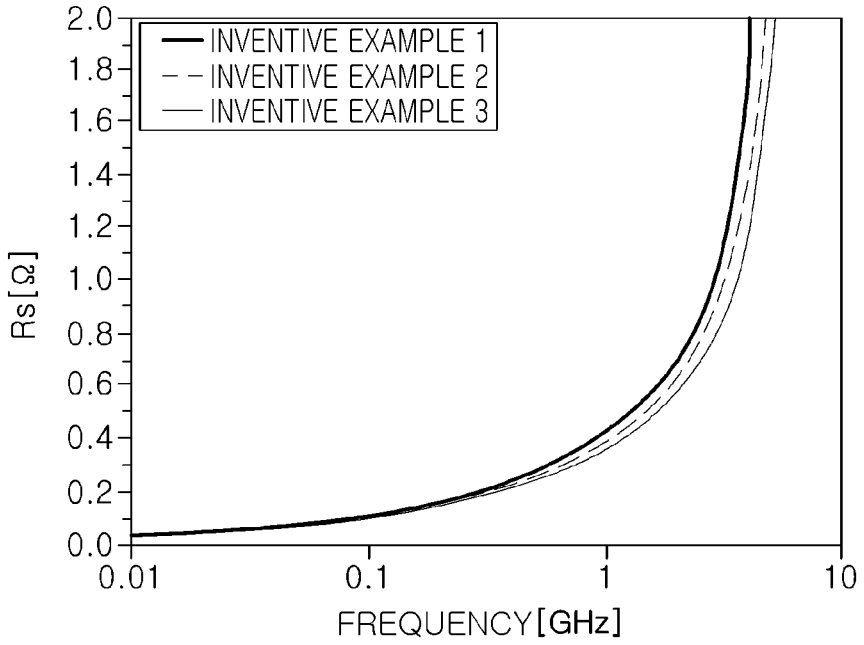
FIG. 7 is a graph showing resistance of the multilayer inductor according to an exemplary embodiment of the present disclosure.

In experimental examples with reference to FIGS. 5 through 7, a dielectric layer in Inventive Example 1 had a thickness of 20 μm, a dielectric layer in Inventive Example 2 had a thickness of 40 μm, and a dielectric layer in Inventive Example 3 had a thickness of 60 μm. Other structures and conditions were the same in Inventive Examples 1 to 3.

Referring to FIGS. 5 through 7, it may be appreciated that in Inventive Examples 1 to 3, inductance was improved by about 5% to 14%, a Q factor was improved by about 5% to 7%, and resistance was improve by about 7% to 19%.

That is, in an exemplary embodiment of the present disclosure, the pad patterns may be formed at the positions of the via electrodes between the conductor patterns and the dielectric layers to increase a vertical distance between the conductor patterns, thereby improving a Q factor and optimizing the vertical distance between the conductor patterns while maintaining connectivity of the via electrodes formed in the dielectric layers. In addition, the thickness of the dielectric layers may be decreased, and thus, an open defect may be decreased.

Hereinafter, a method of manufacturing a multilayer inductor according to an exemplary embodiment of the present disclosure will be described.

First, a plurality of dielectric sheets formed of a material containing a magnetic material, a dielectric material, or the like, may be prepared.

The number of stacked dielectric sheets is not particularly limited, but may be determined depending on intended use of an inductor.

Next, conductor patterns may be formed on the dielectric sheets, respectively.

The conductor patterns may be formed of a material having excellent electrical conductivity, for example, a conductive material such as silver (Ag) or copper (Cu) or an alloy thereof. However, the material of the conductor patterns is not limited thereto.

Here, the conductor patterns may be formed, for example, by a thick film printing method, a paste applying method, a deposition method, a sputtering method, a thin film plating method, or the like. However, the method for forming the conductor patterns is not limited thereto.

The conductor pattern may have various shapes, as necessary. For example, the conductor patterns may have a shape corresponding to ¾ of a loop. However, shapes of the conductor patterns may be variously changed into a shape corresponding to ½ of the loop, a shape corresponding to ⅚ of the loop, a shape nearing the whole loop, or the like.

In addition, at least two of the conductor patterns may serve as first and second connection patterns exposed to both end surfaces of the main body, respectively.

Next, conductive via electrodes may be formed in the individual dielectric sheets.

The via electrode may be formed by forming a through-hole in the dielectric sheet and filling the through-hole with a conductive paste, or the like.

The conductive paste may be formed of a material having excellent electrical conductivity and may contain at least one of silver (Ag), silver-palladium (Ag—Pd), nickel (Ni), copper (Cu) and alloys thereof. However, the conductive paste is not limited thereto.

Next, in the state in which pad patterns are disposed between the conductor patterns and the dielectric sheets at positions of the via electrodes, the dielectric sheets may be stacked to allow the conductor patterns disposed so as to be adjacent to each other in a vertical direction, the pad patterns and the via electrodes to contact each other to thereby entirely form a single coil, and the stacked dielectric sheets are pressed to thereby form a multilayer body.

Here, at least one of upper and lower cover sheets may be stacked on at least one of upper and lower surfaces of the multilayer body or a paste formed of the same material as that of the dielectric sheets forming the multilayer body may be printed thereon at a predetermined thickness to thereby form an upper or lower cover layer.

Next, the multilayer body may be sintered to form a main body.

Next, first and second external electrodes may be formed on both end surfaces of the main body so as to be electrically connected to the first and second connection patterns exposed to the outside of the main body, respectively.

The first and second external electrodes may be formed of a material having excellent electrical conductivity, for example, a conductive material such as silver (Ag) or copper (Cu), or an alloy thereof. However, the material of the external electrodes is not limited thereto.

In addition, nickel (Ni) or tin (Sn) may be plated on surfaces of the first and second external electrodes as described above, if necessary, to form plated layers.

In this case, the first and second external electrodes may be formed by a general method known in the art, for example, a thin film printing method, a paste applying method, a deposition method, a sputtering method, or the like. However, the present disclosure is not limited thereto.

As set forth above, according to exemplary embodiments of the present disclosure, the pad patterns may be formed at the positions of the via electrodes between the conductor patterns and the dielectric layers to increase a vertical distance between the conductor patterns, thereby improving a Q factor and optimizing a vertical distance between the conductor patterns while maintaining connectivity of the via electrodes formed in the dielectric layers. In addition, the thickness of the dielectric layers may be decreased, and thus, an open defect may be decreased.

While exemplary embodiments have been shown and described above, it will be apparent to those skilled in the art that modifications and variations could be made without departing from the spirit and scope of the present disclosure as defined by the appended claims.

What is claimed is:

1. A multilayer inductor comprising:

a body having a plurality of dielectric layers stacked therein;

a plurality of conductor patterns formed on the plurality of dielectric layers;

via electrodes formed in the dielectric layers and connecting the conductor patterns disposed adjacent to each other in a vertical direction to form a coil; and pad patterns formed between the conductor patterns and the dielectric layers at positions of the via electrodes, wherein a width of at least one of the pad patterns is equal to or less than a width of at least one of the plurality of conductor patterns.

2. The multilayer inductor of claim 1, wherein an edge of the pad pattern coincides with an edge of the conductor pattern adjacent to a corresponding side surface of the body.

3. The multilayer inductor of claim 1, wherein the conductor pattern is formed in a shape corresponding to ½ of a loop.

4. The multilayer inductor of claim 1, wherein the conductor pattern is formed in a shape corresponding to ¾ of a loop.

5. The multilayer inductor of claim 1, wherein the conductor pattern is formed in a shape corresponding to ⅚ of a loop.

6. The multilayer inductor of claim 1, wherein the conductor pattern is formed in a shape nearing a whole loop.

7. The multilayer inductor of claim 1, wherein the plurality of conductor patterns include first and second connection patterns exposed to both end surfaces of the body.

8. The multilayer inductor of claim 7, further comprising first and second external electrodes formed on the end surfaces of the body and connected to the first and second connection patterns, respectively.

9. The multilayer inductor of claim 1, further comprising upper and lower cover layers disposed in upper and lower portions of the body.

* * * * *